US009989231B2

(12) United States Patent
Mai et al.

(10) Patent No.: US 9,989,231 B2
(45) Date of Patent: Jun. 5, 2018

(54) ARROW TAIL LAMP

(71) Applicants: Kanglin Mai, Foshan (CN); Yaofen Zhong, Foshan (CN)

(72) Inventors: Kanglin Mai, Foshan (CN); Yaofen Zhong, Foshan (CN)

(73) Assignees: Kanglin Mai, Foshan (CN); Yoafen Zhong, Foshan (CN)

( * ) Notice: Subject to any disclaimer, the term of this patent is extended or adjusted under 35 U.S.C. 154(b) by 179 days.

(21) Appl. No.: 14/933,104

(22) Filed: Nov. 5, 2015

(65) Prior Publication Data

US 2017/0082276 A1 Mar. 23, 2017

(30) Foreign Application Priority Data

Sep. 23, 2015 (CN) ..... 2015 2 0748216 U

(51) Int. Cl.

| | |
|---|---|
| ***F21L 4/00*** | (2006.01) |
| ***F21V 23/04*** | (2006.01) |
| ***F21V 33/00*** | (2006.01) |
| ***F42B 6/06*** | (2006.01) |
| ***F42B 12/38*** | (2006.01) |
| ***F42B 12/40*** | (2006.01) |

(52) U.S. Cl.

CPC ..... *F21V 23/0492* (2013.01); *F21V 33/008* (2013.01); *F42B 6/06* (2013.01); *F42B 12/382* (2013.01); *F42B 12/40* (2013.01)

(58) Field of Classification Search

CPC ..... F21V 23/0414; F21V 23/0421; F21V 33/008; F42V 12/362; F42V 12/382; F42V 12/42; F42V 6/04

See application file for complete search history.

(56) References Cited

U.S. PATENT DOCUMENTS

| | | | | |
|---|---|---|---|---|
| 5,141,229 A * | 8/1992 | Roundy | ..... | H01H 35/14 200/61.53 |
| 6,123,631 A * | 9/2000 | Ginder | ..... | F42B 6/06 473/570 |
| 2007/0105667 A1* | 5/2007 | Takahashi | ..... | A63B 65/00 473/578 |
| 2013/0023364 A1* | 1/2013 | Draper | ..... | F42B 6/08 473/570 |

* cited by examiner

*Primary Examiner* — Elmito Breval
*Assistant Examiner* — Meghan Ulanday
(74) *Attorney, Agent, or Firm* — Dority & Manning, P.A.

(57) ABSTRACT

The invention discloses a novel arrow tail lamp, comprising an inertial on-off loop formed by the connection of a shell, a low voltage light source and an inertia switch, the inertial on-off loop can be switched between a closed circuit and an open circuit under the function that the inertia switch is functioned by the inertia in a same direction, and an inertial on-off loop formed by the low voltage light source and the power supply through the inertia switch, is arranged in the shell. The novel arrow tail lamp can be started depending on the inertia when the arrow is shot, therefore arrow shooting process is a process of starting the novel arrow tail lamp; furthermore, after the user swings the arrow tail downwards, the disconnection of the on inertial on-off loop can be realized, so that the novel arrow tail lamp is convenient and quick to use.

9 Claims, 5 Drawing Sheets

ARROW TAIL LAMP

CROSS REFERENCE TO RELATED APPLICATION

This application claims priority to and the benefit of Chinese Patent Application No. 201520748216.6 filed in the Chinese Intellectual Property Office on Sep. 23, 2015, the entire contents of which are incorporated herein by reference.

FIELD OF THE INVENTION

The invention relates to a novel arrow tail lamp.

BACKGROUND OF THE INVENTION

Many people like hunting by arrows at night, specifically for those abroad. In order to be convenient for getting back the shot arrows, the arrow tail lamps are frequently arranged on arrow tails. However, an existing arrow tail lamp fundamentally needs to be lightened in advance before the arrow is shot, therefore this lightening way consumes more time, and the best opportunity of hunting is missed frequently under the condition that a prey is met suddenly. Meanwhile, when the arrow is fitted to the string, eye pupils are shrunk due to the entering of light beams of the arrow tail when a person is close to the arrow tail to aim at the prey because the arrow tail gives out light, therefore the visual range is shortened and the person is not beneficial for aiming at a target. Furthermore, the existing arrow tail lamp is troublesome to turn off.

SUMMARY OF THE INVENTION

The technical problem solved by the novel arrow tail lamp according to the present invention is to provide an arrow tail lamp, which is convenient to turn off, is lightened depending on the inertia of shooting an arrow.

The solution for solving the technical scheme by the novel arrow tail lamp is that:

A novel arrow tail lamp, comprising a shell, wherein a low voltage light source and a power supply which are arranged in the shell, and further comprising an inertia switch which is arranged in the shell;

An inertial on-off loop is formed by the electric connection of the low voltage light source and the power supply through the inertia switch, and the inertial on-off loop can be switched between a closed circuit and an open circuit under the function that the inertia switch is functioned by the inertia in a same direction.

As the further improvement of the technical scheme, the inertia switch comprises pushing parts, further comprises a status combining part connected with the pushing parts, and the status combining part comprises locking parts and virtual connection parts;

The pushing parts are separated from the virtual connection parts and then are matched with the locking parts, so that the on/off of the inertial on-off loop can be realized; the pushing parts are separated from the locking parts and then are matched with the virtual connection parts, so that the turning off/on of the inertial on-off loop can be realized correspondingly.

As the further improvement of the technical scheme, the inertia switch further comprises reversing part which pushes the pushing parts to switch between the locking parts and the virtual connection parts inertially.

As the further improvement of the technical scheme, the inertia switch further comprises an elastic component which provides holding power to connect the pushing parts with the status combining part, and the elastic component is adjacent to the pushing parts.

As the further improvement of the technical scheme, the low voltage light source is arranged at the tail end of the shell and is provided with an electrode a and an electrode b; a power supply is arranged in front of the low voltage light source, and is provided with an electrode c adaptive to the electrode a and an electrode d adaptive to the electrode b, and the electrode a is connected with the electrode c; the low voltage light source electrode b is electrically connected with the elastic component, and the elastic component is arranged in front of the power supply.

As the further improvement of the technical scheme, the locking parts and the virtual connection parts are both arranged on the inner wall of the shell, the pushing parts, which are arranged in front of the elastic component, can slide in the shell, the reversing part, which are arranged in front of the pushing parts, can slide in a shell cavity area where the status combining part is arranged.

As the further improvement of the technical scheme, the status combining part further comprises guiding parts which guide the pushing parts to the virtual connection parts from the locking parts; the reversing part, the pushing parts, the locking parts, the virtual connection parts, and the guide parts are all provided with operating slopes with same inclining directions.

As the further improvement of the technical scheme, the elastic part comprises an outer spring and an inner spring which is arranged in the outer spring.

As the further improvement of the technical scheme, the inertia switch further comprises an impact block which improves inertia force, the inertia switch comprises at least two locking parts, and the virtual connection part is formed in a gap between every two adjacent locking parts.

As the further improvement of the technical scheme, the shell is provided with two ends, and one of ends is provided with a wire clamping slot.

The novel arrow tail lamp provided by the invention has the beneficial effects that the inertial on-off loop, which is formed by the low voltage light source and the power supply through the inertia switch, is arranged in the shell. After the arrow tail lamp is arranged at the arrow tail, the inertia on-off loop can be accessed so that the low voltage light source gives out light due to inertia when a user shoots an arrow, and the shot arrow can be easily found out according to light beams on the arrow tail, so as to realize arrow recovery and prey tracking. The novel arrow tail lamp provided by the invention can be started depending on the inertia when the arrow is shot, therefore an arrow shooting process is a process of starting the novel arrow tail lamp; furthermore, after the user swings the arrow tail downwards, so that the disconnection of the closed circuit of the inertial on-off loop can be realized, and the novel arrow tail lamp is convenient and quick to use. The novel arrow tail lamp provided by the invention is used for the arrow tail lamp.

BRIEF DESCRIPTION OF THE DRAWINGS

In order to specify the technical scheme in the embodiment of the novel arrow tail lamp more clearly, drawings used in the description of the embodiment can be specified in the description of the embodiment below. Obviously, the described drawings are only a part of the embodiments of the invention, but not all embodiments. Those skilled in the art can obtain other design schemes and drawings in accordance with the drawings under the precondition that creative labor need not to be paid out.

DETAILED DESCRIPTION OF THE EMBODIMENTS

Figure 1:
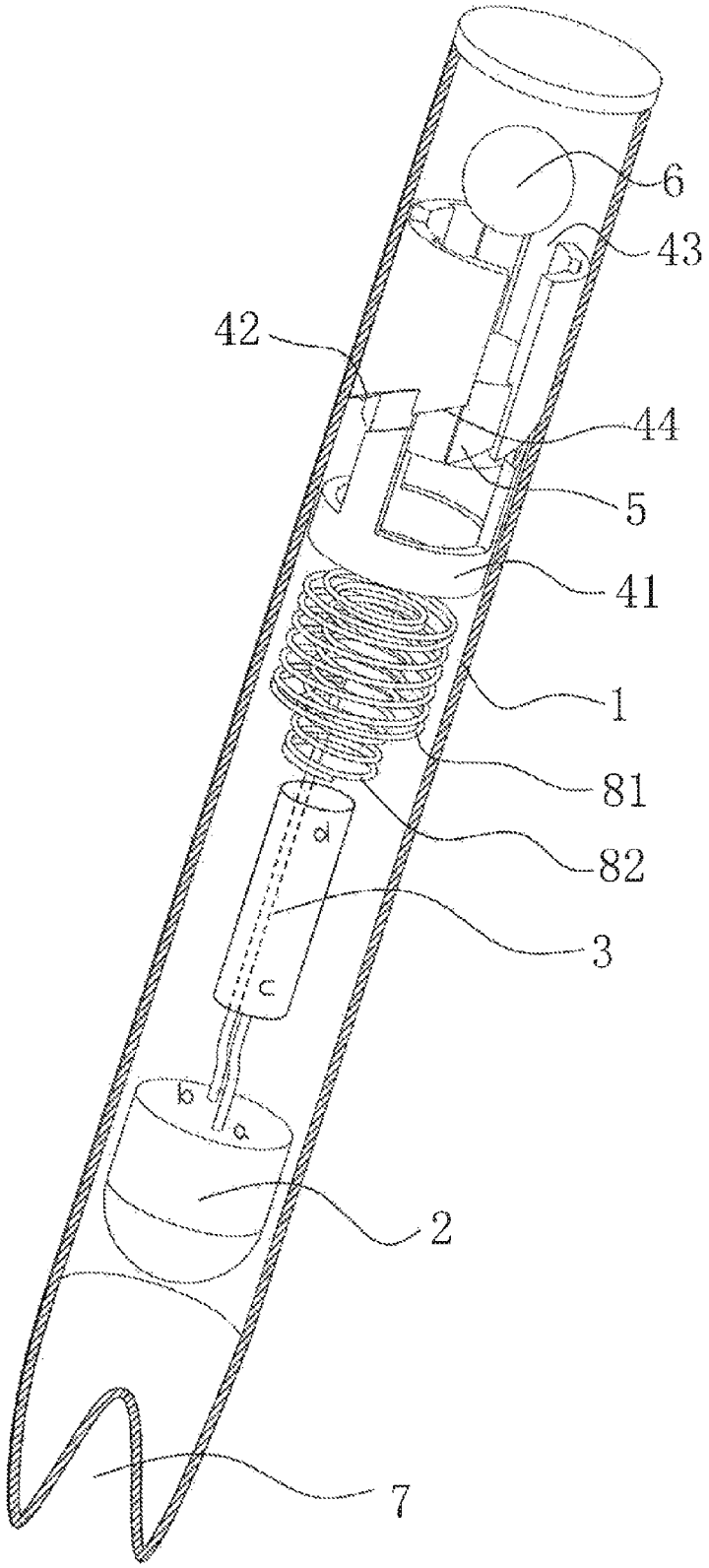
FIG. 1 is a three-dimensional schematic diagram of the structure of the embodiment a1 according to the novel arrow tail lamp.
Figure 2:
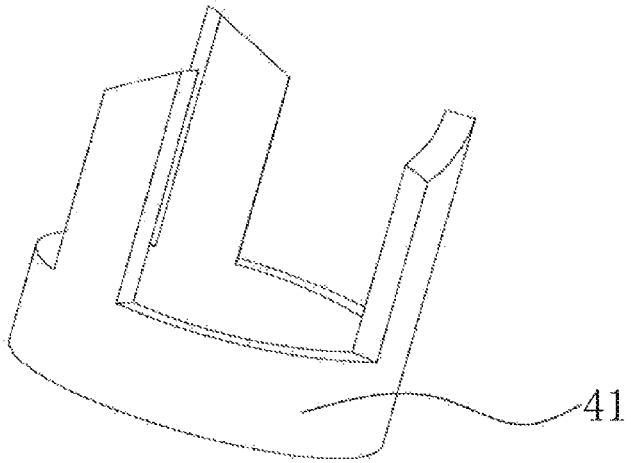
FIG. 2 is a three-dimensional schematic diagram of pushing part of the embodiment a1 according to the novel arrow tail lamp.
Figure 3:
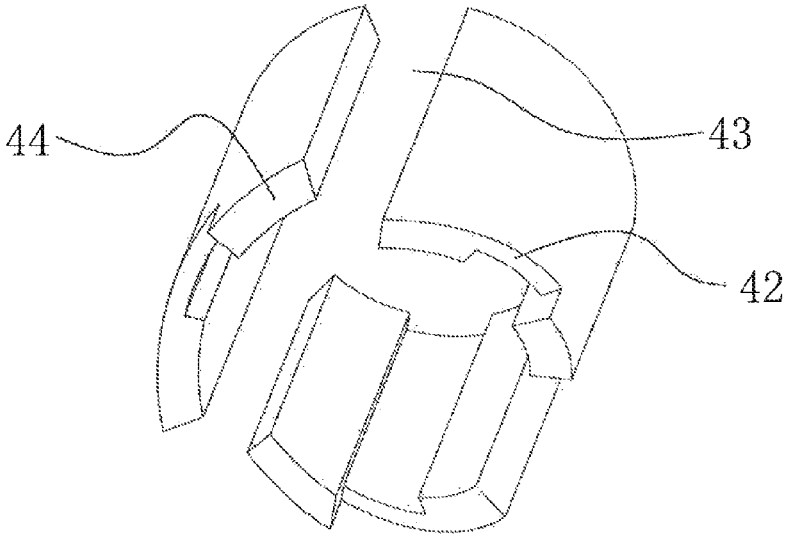
FIG. 3 is a three-dimensional schematic diagram of a status combining part of the embodiment a1 according to the novel arrow tail lamp.
Figure 4:
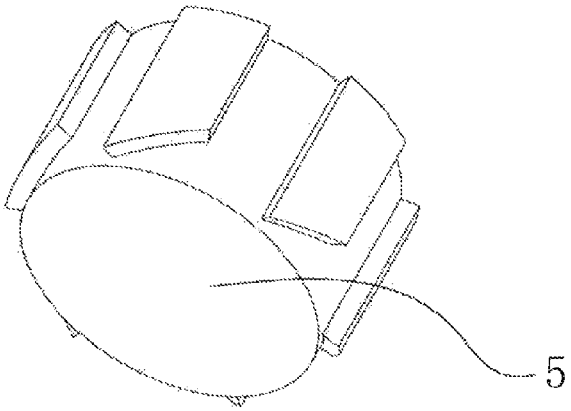
FIG. 4 is a three-dimensional schematic diagram of reversing part of the embodiment a1 according to the novel arrow tail lamp.
Figure 5:
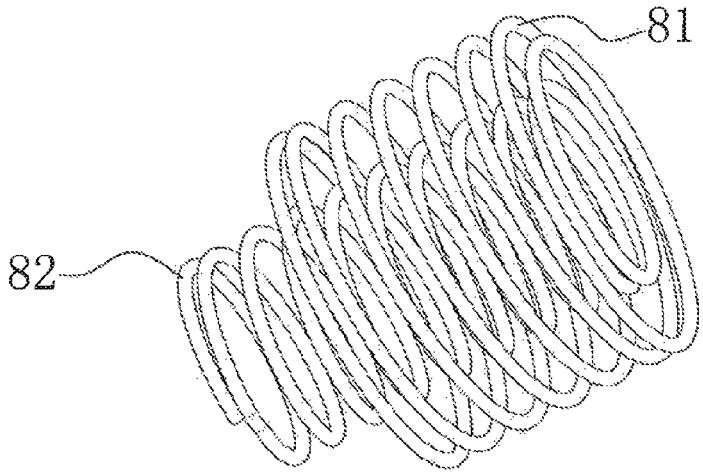
FIG. 5 is a three-dimensional schematic diagram of elastic component of the embodiment a1 according to the novel arrow tail lamp.
Figure 6:
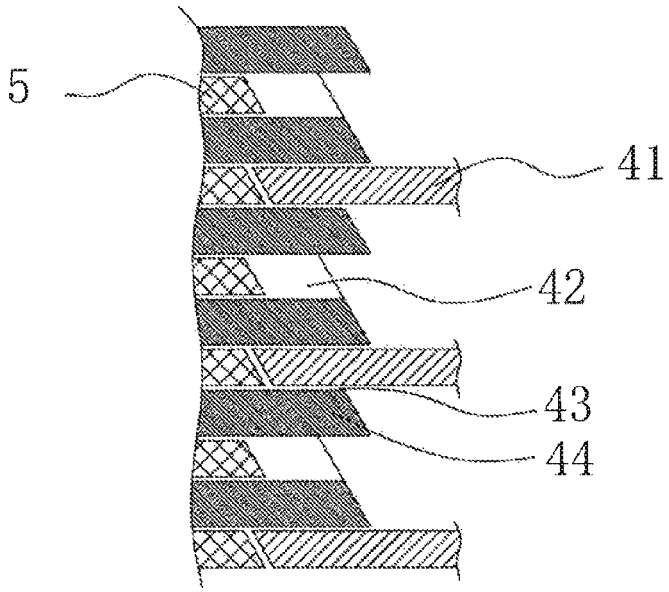
FIG. 6 is a principal schematic diagram of the pushing parts of the embodiment a1 according to the novel arrow tail lamp when the reversing part in the virtual connection parts are pushed.
Figure 7:
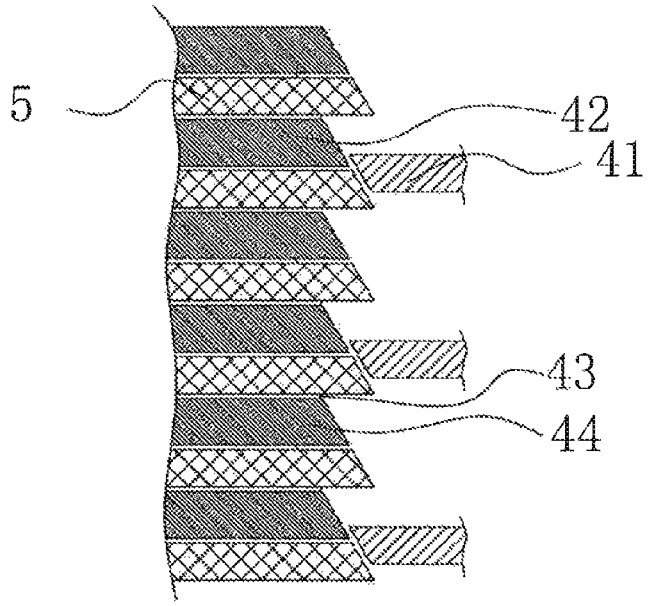
FIG. 7 is a principal schematic diagram of the reversing part of the embodiment a1 according to the novel arrow tail lamp when the reversing part enter guide parts.
Figure 8:
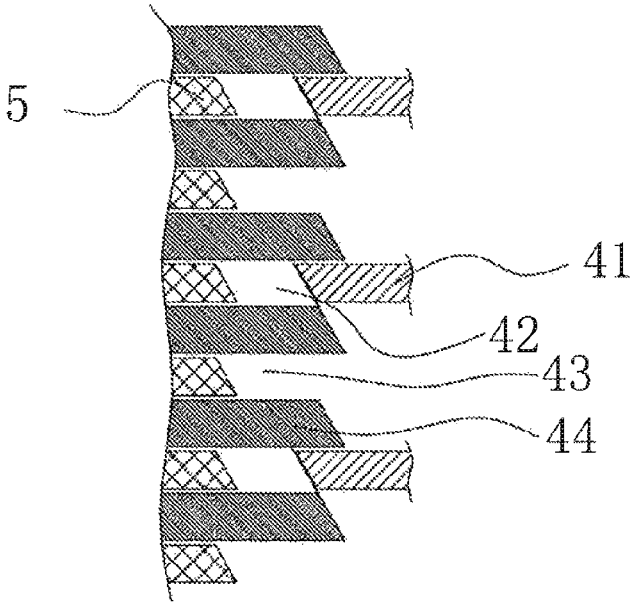
FIG. 8 is a principal schematic diagram of the reversing part of the embodiment a1 according to the novel arrow tail lamp when the reversing part are matched with locking parts.

The concept, concrete structure and generated technical effect of the novel arrow tail lamp can be described clearly and completely by combining the embodiments and the drawings, so as to understand the target, features and effects of the novel arrow tail lamp completely. Obviously, the described embodiments are only a part of embodiments of the novel arrow tail lamp, but not all embodiments. Based on the embodiments of the novel arrow tail lamp, the condition, that the technicians can obtain other embodiments under the precondition of not paying out the creative labor, belongs to the protective scope of the novel arrow tail lamp. In addition, all linking/connection relations involved in this paper do not mean the direction connection of components, but mean a more optimal connection structure which can be formed by adding or reducing connection auxiliaries in accordance with the specific implementing conditions.

Embodiment a1

Referring to FIG. 1 to FIG. 8, an inner cavity of a shell 1 is provided with a low voltage light source 2 with an electrode a and an electrode b, the low voltage light source 2 is an LED (Light Emitting Diode) lamp bead, the electrode a is an anode of the LED lamp bead, and the electrode b is a cathode of the LED lamp bead. The electrode a of the low voltage light source is connected with an electrode c of a power supply 3, and the electrode c is an anode of the power supply 3; and the electrode d of the power supply 3 is a cathode. The electrode b is connected with an elastic component so that the electrode b is effectively connected with or separated from an electrode d for certain connecting strength or allowance. Three pushing parts 41, which are integrally connected, are arranged above the elastic component, three groups of locking parts 42 and guide parts 44 are distributed uniformly on the inner wall of the shell 1 above the pushing parts 41, and a gap, which is capable of accommodating each pushing part 41, is arranged between each group of locking parts 42 and the corresponding guide part 44, so as to form a virtual connection part 43. The elastic component comprises an outer spring 81 and an inner spring 82, the outer spring 81 is compressed by the pushing parts 41 when the pushing parts 41 are connected with the locking parts so that the inner spring 82 moves downwards and the electrode b is electrically connected with the electrode d. The electrode d of the power supply 3 is pressed by the inner spring 82 by adjusting the connecting heights of the pushing parts 41 and the locking parts 42. The pushing parts 41 are further provided with the reversing part 5 on their upside, the reversing part are matched on slopes that the pushing parts 41 are matched with the reversing part 5 under the downward inertia effect so that the pushing parts 41 turn to the guide parts 44 and the pushing parts are guided into the virtual connection parts 42 by the guide parts, therefore the outer spring 81 is unfolded and bounced off, and the inner spring 82 leaves away from the electrode d of the power supply 3. The low voltage light source 2 and the power supply 3 are connected to form an inertial on-off loop by an inertia switch consisting of the pushing parts 41, the locking parts 42, the virtual connection parts 43, the reversing part 5, the guiding parts 44, the outer spring 81 and the inner spring, and the downward inertia force is generated by a swinging way, so that the turning-on or turning-off of the inertial on-off loop can be realized by the reversing part, but the inertia force means the inertia force generated by shooting the arrow, rather than the inertia force generated by swinging the arrow tail lamp. Of course, the inertia switch can realize the on or off of the inertial on-off loop depending on the inertia of the pushing parts 41 only.

With view to the convenience in manufacture and production cost, the reversing part 5 are generally made from plastics by using a mould, so that the inertia force is not enough; furthermore, in order to be convenient for adjusting the inertia force, the inertia switch is further provided with impact blocks 6 arranged above the reversing part 5.

In order to be convenient for a user to use, the user does not additionally arrange a wire clamping slot component at the lower end of the shell 1, therefore the wire clamping slot 7 is formed in the lower end of the shell 1.

Embodiment a2

Figure 9:
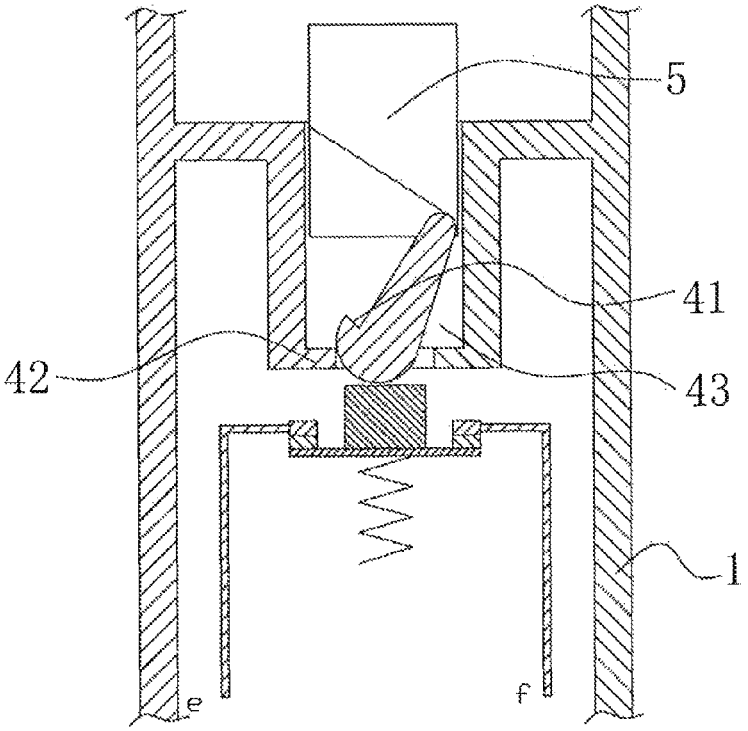
FIG. 9 is a structural schematic diagram of the embodiment a2 according to the novel arrow tail lamp when the pushing parts in the inertia switch are matched with the virtual connection parts, and the rest of structures are not as shown.
Figure 10:
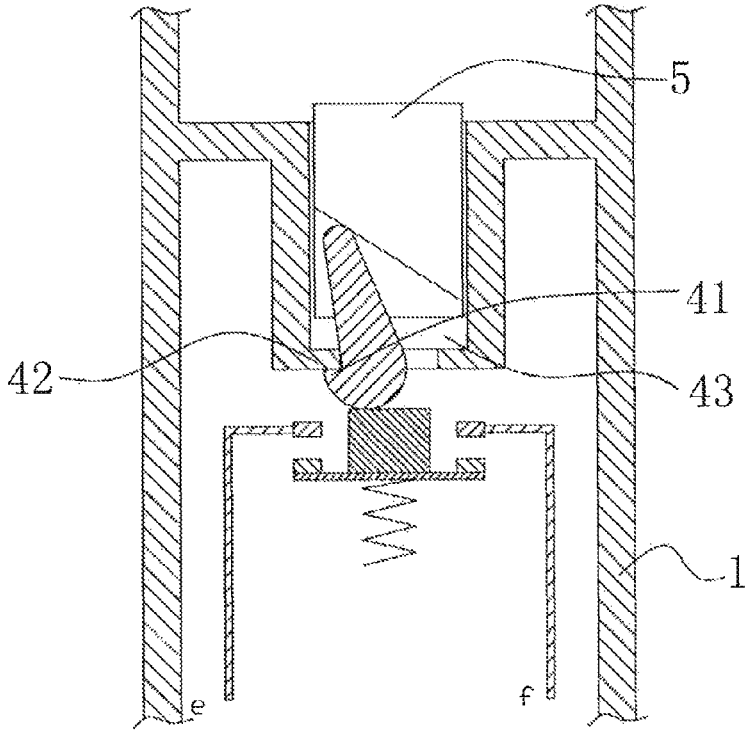
FIG. 10 is a structural schematic diagram of the embodiment a2 according to the novel arrow tail lamp when the pushing parts in the inertia switch are matched with the locking parts, and the rest of structures are not as shown.

Referring to FIG. 9 to FIG. 10, an inertia switch of the embodiment a1 comprises pushing parts 41 and locking parts 42 arranged on a shell 1; the inertia switch further comprises reversing part 5, virtual connection parts 43 located below the reversing part 5 and an elastic component arranged below the pushing parts 41, wherein the virtual connection parts 43 are gaps located between the reversing part 5 and the locking parts 42, and the elastic component is springs; the inertia switch further comprises an electrode e and an electrode f which are respectively connected with a low voltage light source 2 and a power supply 3. FIG. 9 shows a structure chart of the connecting relationship of all parts of the inertia switch when the inertia on-off loop is a closed circuit, the reversing part 5 are driven by the downward inertia force so that the locking parts 42 of the virtual connection parts 43 contrarotate and move downwards when the novel arrow tail lamp is swung downwards, the pushing parts 41 are pushed upwards so that the locking parts 42 are buckled by the pushing parts 41 when the swinging is completed or the swinging speed is reduced, i.e. the connecting relationship of all parts of the inertia switch is as shown in FIG. 10, and the inertial on-off loop is an open circuit.

The better implementation ways of the novel arrow tail lamp are specially specified, but the novel arrow tail lamp is not limited to the embodiments. Those skilled in the art can do various equal deformations or replacements under the precondition that the spirit of the novel arrow tail lamp cannot be broken, and all equal deformations or replacements are involved in the scope limited by the claims of this application.

The invention claimed is:

1. A novel arrow tail lamp, comprising a shell, wherein a low voltage light source and a power supply arranged in the shell, further comprising an inertia switch which is arranged in the shell, wherein an inertial on-off loop is formed by the electric connection of the low voltage light source and the power supply through the inertia switch, and the inertial on-off loop is switched between a closed circuit and an open circuit when the inertia switch is subjected to the inertia in a same direction, wherein the inertia switch comprises pushing parts, and further comprises a status combining part connected with the pushing parts, and the status combining part comprises locking parts and virtual connection parts; wherein the pushing parts are separated from the virtual connection parts and then are matched with the locking parts, so that the on/off state of the inertial on-off loop can be realized; wherein the pushing parts are separated from the locking parts and then are matched with the virtual connection parts, so that the off/on state of the inertial on-off loop can be realized correspondingly.

2. The novel arrow tail lamp according to claim 1, characterized in that the inertia switch further comprises a reversing part which pushes the pushing parts to switch between the locking parts and the virtual connection parts inertially.

3. The novel arrow tail lamp according to claim 2, characterized in that the inertia switch further comprises an elastic component which provides holding power to connect the pushing parts with the status combining part, and the elastic component is adjacent to the pushing parts.

4. The novel arrow tail lamp according to claim 3, characterized in that the low voltage light source is arranged at the tail end of the shell, and is provided with an electrode a and an electrode b; the power supply is arranged in front of the low voltage light source, and is provided with an electrode c adaptive to the electrode a and an electrode d adaptive to the electrode b, and the electrode a is connected with the electrode c; and the electrode b of the low voltage power supply is electrically connected with the elastic component which is arranged in front of the power supply.

5. The novel arrow tail lamp according to claim 4, characterized in that the locking parts and the virtual connection parts are both arranged on the inner wall of the shell, and the pushing parts, which are arranged in front of the elastic component, can slide in the shell, and the reversing part, which are arranged in front of the pushing parts, can slide in a cavity area of the shell where the status combining part is arranged.

6. The novel arrow tail lamp according to claim 5, characterized in that the status combining part further comprises guide parts which are used for guiding the pushing parts to the virtual connection parts from the locking parts, and the reversing part, the pushing parts, the locking parts and the guide parts are all provided with operating slopes with same directions of tilt.

7. The novel arrow tail lamp according to claim 6, characterized in that the elastic part comprises an outer spring and an inner spring which is arranged in the outer spring.

8. The novel arrow tail lamp according to claim 1, characterized in that the inertia switch further comprises an impact block which increases the inertia, and the inertia switch comprises at least two locking parts, and each virtual connection part is formed in a gap between every two adjacent locking parts.

9. The novel arrow tail lamp according to claim 8, characterized in that the shell is provided with two ends, and one of ends is provided with a wire clamping slot.

* * * * *